US006903321B2

(12) United States Patent
Kanzaki et al.

(10) Patent No.: US 6,903,321 B2
(45) Date of Patent: Jun. 7, 2005

(54) HIGH-FREQUENCY HEATING APPARATUS WITH ILLUMINATION DEVICE

(75) Inventors: Kouji Kanzaki, Yamatokoriyama (JP); Kazuhiro Kawai, Ibaraki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/471,901

(22) PCT Filed: Nov. 12, 2002

(86) PCT No.: PCT/JP02/11800

§ 371 (c)(1),
(2), (4) Date: Sep. 15, 2003

(87) PCT Pub. No.: WO03/043381

PCT Pub. Date: May 22, 2003

(65) Prior Publication Data

US 2004/0188432 A1 Sep. 30, 2004

(30) Foreign Application Priority Data

Nov. 13, 2001 (JP) ..... 2001-347020

(51) Int. Cl.[7] ..... H05B 6/64; F24C 7/02

(52) U.S. Cl. ..... 219/758; 219/757; 362/92

(58) Field of Search ..... 219/758, 757; 362/92

(56) References Cited

U.S. PATENT DOCUMENTS 3,308,261 A 3/1967 Velander

FOREIGN PATENT DOCUMENTS

| | | | |
|---|---|---|---|
| JP | 63-32221 | * 2/1988 | ..... 219/758 |
| JP | 63-281384 | * 11/1988 | ..... 219/720 |
| JP | 1-269826 | * 10/1989 | ..... 219/758 |

* cited by examiner

*Primary Examiner*—Philip H. Leung
(74) *Attorney, Agent, or Firm*—Pearne & Gordon LLP

(57) ABSTRACT

To realize an air guide of a radio-frequency heating apparatus that enables fixing of a lamp without use of a vis though it is made of a metal plate material. An air guide 9 made of a metal plate material is formed with two inverted-L-shaped nails 15. A holding portion 13 of a lamp 12 is hooked on the nails 15 and a waveguide holding plate 19 is brought into contact with an opposed surface of the holding portion 13 of the lamp 12. As a result, the lamp 12 can be fixed without using a vis and hence a step of fixing the lamp 12 with a vis can be eliminated. An inexpensive configuration can be realized that is free of fear that a disconnection may occur in a filament due to vibration.

5 Claims, 5 Drawing Sheets

HIGH-FREQUENCY HEATING APPARATUS WITH ILLUMINATION DEVICE

This application claims the benefit of International Application Number PCT/JP02/11800, which was published in English on May 22, 2003.

TECHNICAL FIELD

The present invention relates to the structure of an air guide for guiding air to a heating chamber in a radio-frequency heating apparatus.

BACKGROUND OF THE ART

Among conventional radio-frequency heating apparatuses of a type concerned are ones that are provided with an air guide for guiding air to a heating chamber to prevent dew condensation there and clouding of a door inner surface. The air guide is produced by shaping a metal plate-like material or a resin material into a generally U-shaped form. An illumination device is fixed to the inside of the air guide. FIG. 5 shows the configuration of a conventional radio-frequency heating apparatus.

In FIG. 5, reference numeral 1 denotes a heating chamber for housing a cooking object; 2, a door for inputting and outputting the cooking object; 3, a magnetron for supplying radio-frequency waves to the heating chamber; 4, a high-voltage transformer for supplying power to the magnetron 3; 5, a cooling fan for cooling electric parts; 6, an air guide for guiding air to the heating chamber 1; a waveguide for holding the magnetron 3 and guiding the generated radio-frequency waves to the heating chamber 1; and 8, an illumination device for illuminating the cooking object in the heating chamber 1.

In the above conventional configuration, if the air guide 6 is made of a resin material, when the illumination device 8 is attached to the air guide 6, the illumination device 8 can easily be held by the air guide 6 by using fixing nails that were formed by molding. However, if the air guide 6 is made of a metal plate, it is insufficient to hook the illumination device 8 on a bent metal portion; fixing with a vis is indispensable. However, fixing the illumination device 8 with a vis causes a problem that when the door 2 of the radio-frequency heating apparatus is opened or closed, vibration is transmitted to the filament or the like and a disconnection may occur there. This makes it necessary to use a special, stepped vis or sandwiching a buffer member between the vis and the illumination apparatus 8.

Further, the temperature tends to vary to a larger extent in metal plates than in resin materials. This results in a problem that after completion of cooking, steam that goes back from the heating chamber 1 likely condenses into dew, whereby water droplets may drop onto electric parts that are disposed under the air guide 6 to deteriorate their insulation performance.

DISCLOSURE OF INVENTION

The present invention has been made to solve the above problems in the art and an object of the invention is therefore to provide a radio-frequency heating apparatus that is provided with an air guide to which an illumination device can be fixed without using a vis and from which water droplets hardly drop, though it is made of a metal plate.

To solve the above problems, in a radio-frequency heating device according to the invention, an air guide made of a metal plate material has a top plate that is provided with at least two inverted-L-shaped nails. One nail is inserted in a hole of the illumination device and another nail holds a peripheral portion of the illumination device. When the air guide is attached to a radio-frequency wave generating device, the peripheral portion of the illumination device contacts the waveguide. Each of a central plate and a bottom plate of the air guide is provided with a guide for guiding water droplets.

With the above configuration, the illumination device is held by the nails of the air guide with slight play. Since the peripheral portion of the illumination device is in contact with the waveguide, the illumination device is prevented from disengaging from the nails. The illumination device can thus be fixed without using a vis. Further, the guides that are provided in the central plate and the bottom plate of the air guide can guide water droplets so that they do not drop onto electric parts that are disposed under the air guide.

According to the invention, there are provided a heating chamber for housing a cooking object, a door that is attached to an opening portion of the heating chamber so as to be able to be opened and closed to thereby allow input and output of the cooking object, an illumination device for illuminating the cooking object in the heating chamber, a radio-frequency wave generating device for generating radio-frequency waves, a waveguide for guiding the generated radio-frequency waves to the heating chamber, a fan for cooling electric parts including a magnetron that is part of the radio-frequency wave generating device, and an air guide for guiding a wind generated by the fan from the magnetron to the heating chamber, and the air guide is made of a metal plate material and has a top plate that is provided with at least one inverted-L-shaped nail. With this configuration, the illumination device is held with slight play, which prevents the problem that when the door of the radio-frequency heating apparatus is opened or closed, vibration is transmitted to the filament or the like and a disconnection may occur there.

According to the invention, the air guide is made of a metal plate material and has a top plate that is provided with at least two inverted-L-shaped nails, and one nail is inserted in a hole of the illumination device and another nail holds a peripheral portion of the illumination device. With this configuration, the illumination device is held with slight play, which prevents the problem that when the door of the radio-frequency heating apparatus is opened or closed, vibration is transmitted to the filament or the like and a disconnection may occur there.

According to the invention, the illumination device is attached at such a position that one peripheral portion thereof comes close to an end of the air guide, and when the air guide is attached to the radio-frequency wave generating device the peripheral portion of the illumination device contacts the waveguide. This prevents the illumination device from disengaging from the nails of the air guide.

According to the invention, the air guide has a central plate that is provided with a projected surface that is inclined so as to decrease in height in a direction from the outside to the heating chamber. With this configuration, when steam goes back from the heating chamber and condenses into dew on the central plate of the air guide and water droplets drop down its inner surface, the water droplets reach the projected surface and are guided by the projected surface to the wall surface of the heating chamber. This prevents the problem that water droplets drop from the air guide onto electric parts to deteriorate their insulation performance. This prevents the problem that water droplets drop from the air guide onto underlying electric parts to deteriorate their insulation performance.

According to the invention, the air guide has a bottom plate that is provided with an inclined surface that is inclined so as to decrease in height in a direction from the outside to the heating chamber. With this configuration, even if steam goes back from the heating chamber and condenses into dew on the bottom plate of the air guide, water droplets are guided by the inclined surface to the wall surface of the heating chamber. This prevents the problem that water droplets drop from the air guide onto underlying electric parts to deteriorate their insulation performance.

BEST MODE FOR CARRYING OUT THE INVENTION

An embodiment of the present invention will be hereinafter described with reference to the drawings.

Embodiment 1

Figure 1:
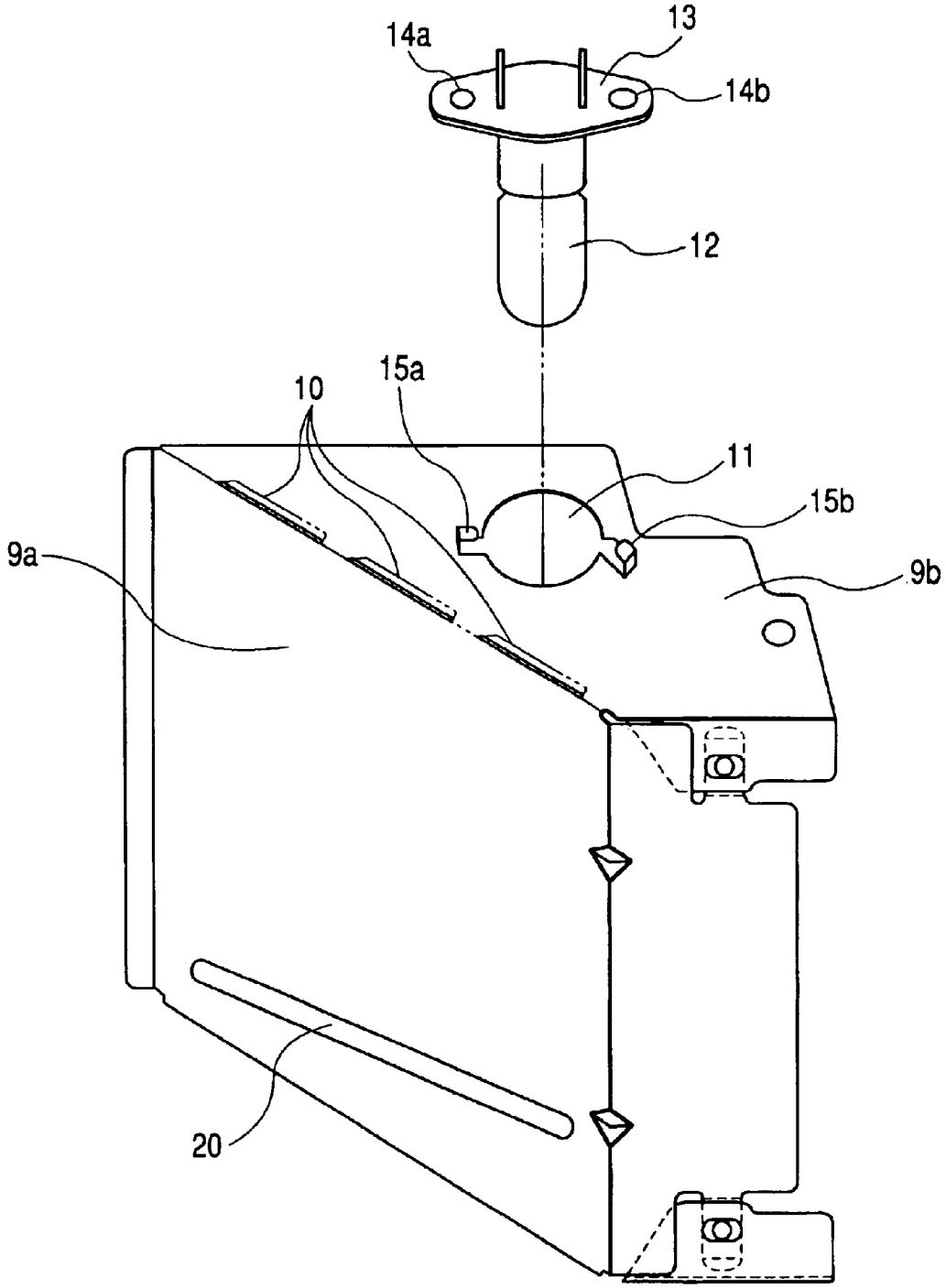
FIG. 1 is a perspective view showing the appearance of an air guide of a radio-frequency heating apparatus according to a first embodiment of the present invention.

FIG. 1 shows the appearance of an air guide of a radio-frequency heating apparatus according to a first embodiment of the invention.

Figure 2:
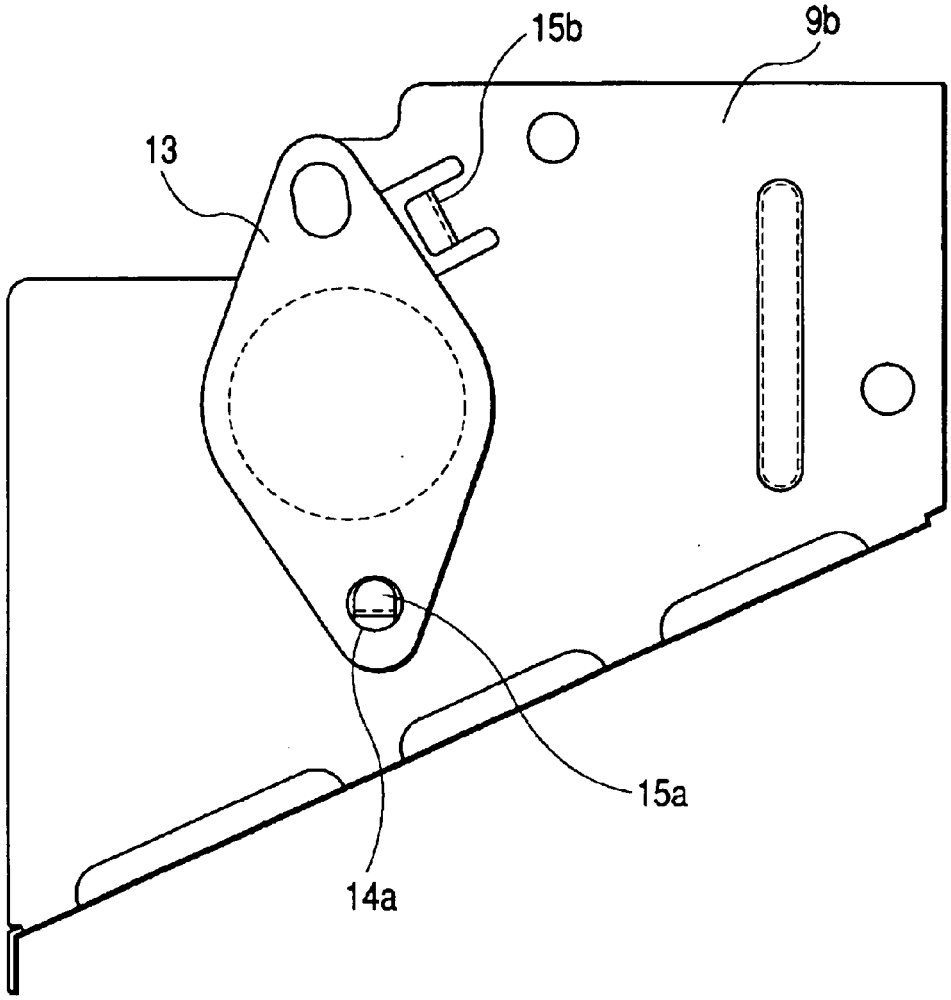
FIG. 2 is a plan view showing the air guide as viewed from above when an illumination device is attached to it in the first embodiment of the invention.

FIG. 2 shows the air guide as viewed from above when an illumination device is attached to it in the radio-frequency heating apparatus according to the first embodiment of the invention.

In FIGS. 1 and 2, reference symbols 9*a*, 9*b*, and 9*c* denote a central plate, a top plate, and a bottom plate (not shown) of the air guide, respectively. Slit-like holes 10 are formed at the boundaries between the central plate 9*a* and the top plate 9*b* and between the central plate 9*a* and the bottom plate 9*c*. The air guide is given a generally U-shaped form by bending the top plate 9*b* and the bottom plate 9*c*. The top plate 9*b* has a lamp hole 11 for fixing a lamp 12 as an illumination device for illuminating a cooking object in the heating chamber. Inverted-L-shaped nails 15*a* and 15*b* are provided adjacent to the hole 11. The lamp 12 is provided with a holding portion 13 that is formed by molding a resin and has two holding holes 14*a* and 14*b*.

Figure 3:
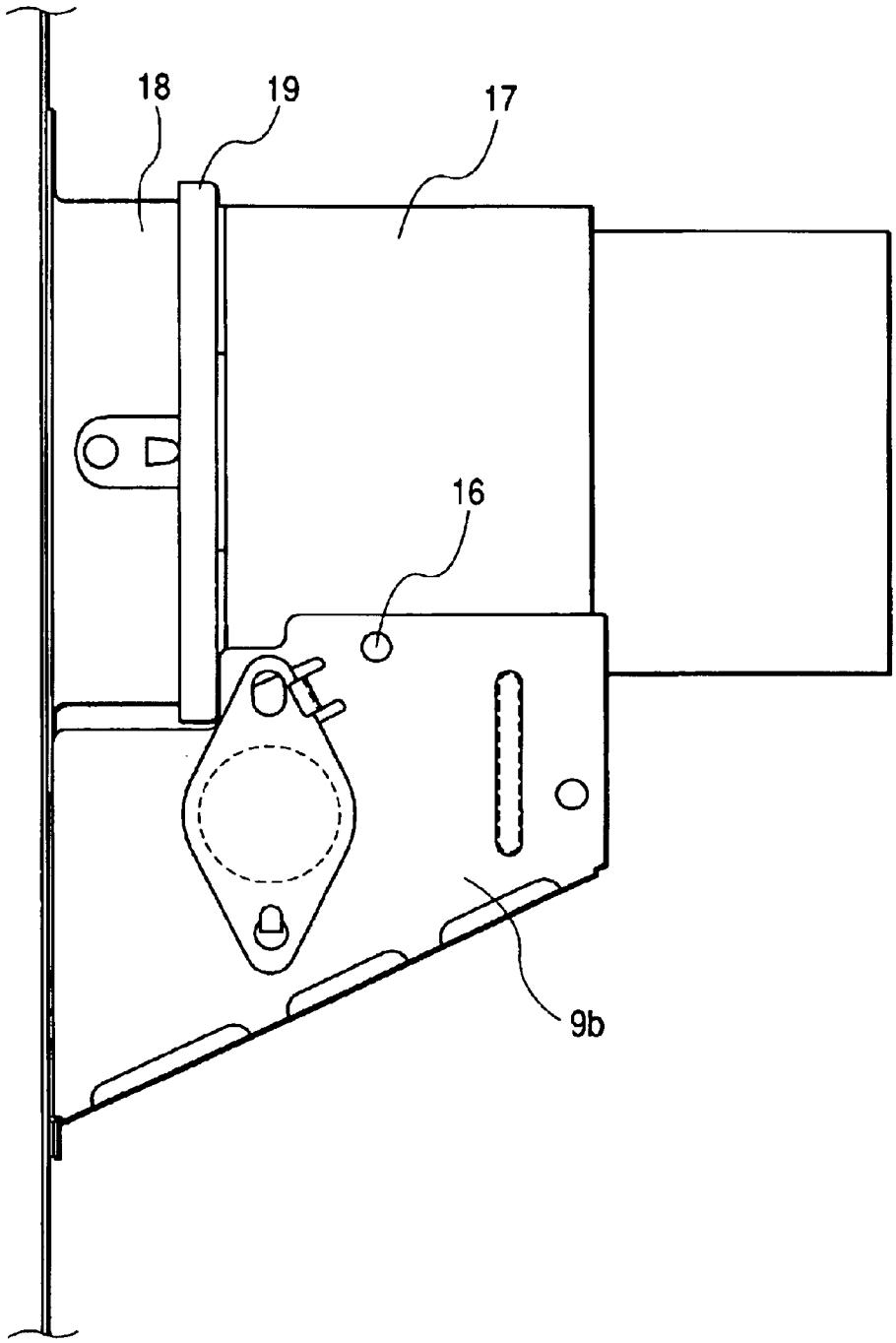
FIG. 3 is a main-part-enlarged view showing the air guide as viewed from above in a state that it is attached to a radio-frequency wave generating device in the first embodiment of the invention.

FIG. 3 shows the air guide as viewed from above in a state that it is attached to a radio-frequency wave generating device of the radio-frequency heating apparatus according to the first embodiment of the invention.

As shown in FIG. 3, the air guide is fixed to a magnetron 17 by inserting a vis or the like into a hole 16 that is formed in the top plate 9*b*. The magnetron 17 is fixed, with vises or the like, to a waveguide holding plate 19 that is fixed to a waveguide 18 by welding or the like. In this state, part of the periphery of the top plate 9*b* of the air guide is close to the holding plate 19.

Figure 4:
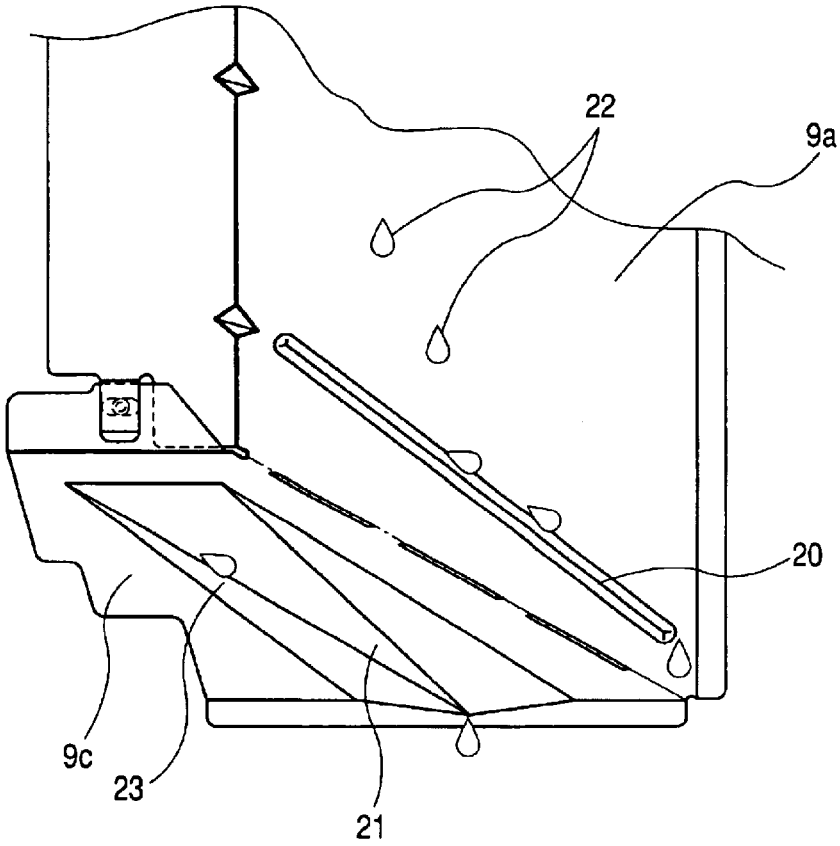
FIG. 4 is a main-part-enlarged view showing the structures of internal surfaces of the air guide according to the first embodiment of the invention.
Figure 5:
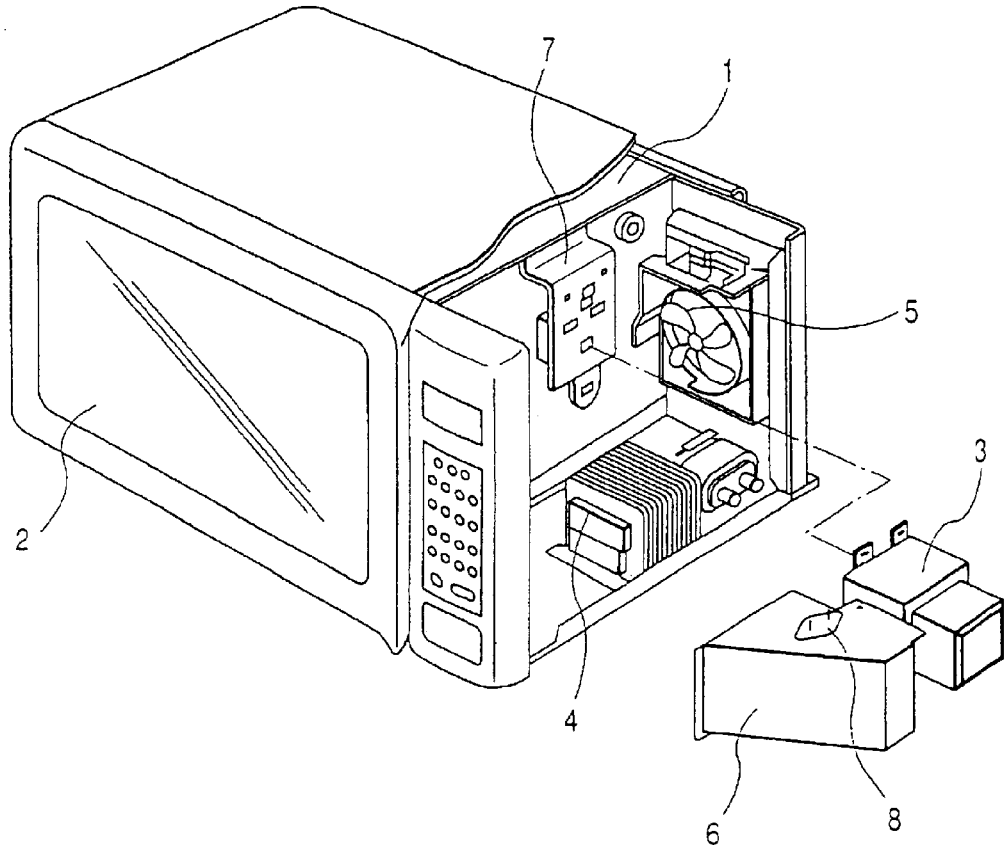
PRIOR ART FIG. 5
FIG. 5 is a perspective view showing the appearance of a conventional radio-frequency heating apparatus.

FIG. 4 shows the structures of internal surfaces of the air guide of the radio-frequency heating apparatus according to the first embodiment of the invention.

As shown in FIG. 4, the central plate 9*a* of the air guide has a projected surface 20 that is convex inward and is inclined so as to decrease in height in the direction from the outside to the heating chamber. The bottom plate 9*c* of the air guide has an inclined surface 21 that is inclined so as to decrease in height in the direction from the outside to the heating chamber.

How the above-configured radio-frequency heating apparatus operates and functions will be described below.

First, the top plate 9*b* of the air guide has the lamp hole 11 for fixing the lamp 12 as the illumination device for illuminating a cooking object in the heating chamber, and the inverted-L-shaped nails 15*a* and 15*b* are provided adjacent to the hole 11. The one nail 15*a* is bent toward the center of the lamp hole 11 so as to assume the inverted-L shape. The other nail 15*b*, which is provided adjacent to that position on the periphery of the lamp hole 11 which is opposed to the one nail 15*a*, and is bent in a direction that forms a certain angle with the direction passing through the center of the hole 11 so as to assume the inverted-L shape. The lamp 12 has the holding portion 13 that is formed by molding a resin and has the two holding holes 14*a* and 14*b*. To attach the lamp 12, the lamp 12 is inserted into the lamp hole 11 and the nail 15*a* is fitted into the one holding hole 14*a*. At this time, deviating the lamp 12 from the center of the lamp hole 11 to the side opposite to the nail 15*b* allows the lamp 12 to be inserted into the lamp hole 11 without causing interference between the nail 15*b* and the holding portion 13. Then, the holding portion 13 is slid toward the nail 15*b*, whereby the centers of the lamp 12 and the lamp hole 11 coincide with each other and a peripheral portion of the holding portion 13 fits into the nail 15*b*. At this time, the lamp 12 can be fixed with some play if the height dimension of the nails 15*a* and 15*b* is set slightly greater than the thickness dimension of the holding portion 13.

When the lamp 12 is attached in such a manner that the centers of the lamp 12 and the lamp hole 11 coincide with each other, the peripheral portion of the holding portion 13 that is opposed to the nail 15*b* is fixed so as to be close to part of the periphery of the top plate 9*b* of the air guide. When the air guide is fixed to the magnetron 17 with vises or the like, the waveguide holding plate 19 is set close to the above part of the periphery of the top plate 9*b* of the air guide and, as a result, contacts the above peripheral portion of the holding portion 13.

The central plate 9*a* of the air guide is formed with the projected surface 20 that is convex inward and is inclined so as to decrease in height in the direction from the outside to the heating chamber. Therefore, when steam goes back from the heating chamber and condenses into dew on the central plate 9*a* of the air guide and water droplets 22 drop down the central plate 9*a*, the water droplets 22 reach the projected surface 20 and are guided by the projected surface 20 to the heating chamber side.

Further, the bottom plate 9*c* of the air guide is formed with the inclined surface 21 that is inclined so as to decrease in height in the direction from the outside to the heating chamber. Therefore, even if steam goes back from the heating chamber and condenses into dew on the bottom plate 9*c* of the air guide, water droplets 23 are guided by the inclined surface 21 to the heating chamber side.

As described above, according to this embodiment, the top plate of the air guide is formed with the two inverted-L-shaped nails. One nail is inserted into the hole of the illumination device and the other nail holds the peripheral portion of the illumination device. In this manner, the illumination device is held with slight play without the need for using a vis. This solves, at a low cost without impairing the workability, the problem that when the door of the radio-frequency heating apparatus is opened or closed, vibration is transmitted to the filament or the like and a disconnection may occur there.

Whereas the width of the nail to be inserted into the hole of the illumination device is restricted by the size of the hole, the width of the nail to hold the peripheral portion of the illumination device is not restricted at all. Therefore, the illumination device can be fixed stably by making the latter nail large.

The illumination device is attached at such a position that its one peripheral portion comes close to an end of the air guide. Therefore, when the air guide is attached to the radio-frequency wave generating device, the peripheral portion of the illumination device contacts the waveguide. This prevents the illumination device from disengaging from the nails of the air guide.

The central plate of the air guide is formed with the projected surface is inclined so as to decrease in height in the direction from the outside to the heating chamber. Therefore, when steam goes back from the heating chamber and condenses into dew on the central plate of the air guide and water droplets drop down its surface, the water droplets reach the projected surface and are guided by the projected surface to the heating chamber side. This prevents the problem that water droplets drop from the air guide onto underlying electric parts to deteriorate their insulation performance.

Although in the embodiment the projected surface has a circular cross-section, a projected surface having a triangular or like cross-section can provide the same advantage.

Although the embodiment employs the single projected surface, employment of a plurality of projected surfaces can enhance the advantage.

The bottom plate of the air guide is formed with the inclined surface that is inclined so as to decrease in height in the direction from the outside to the heating chamber. Therefore, even if steam goes back from the heating chamber and condenses into dew on the bottom plate of the air guide, water droplets are guided by the inclined surface to the heating chamber side. This prevents the problem that water droplets drop from the air guide onto underlying electric parts to deteriorate their insulation performance.

INDUSTRIAL APPLICABILITY

As described above, the present invention makes it possible to construct a radio-frequency heating apparatus that is provided with an inexpensive air guide to which an illumination device can be fixed without using a vis and from which water droplets hardly drop, though it is made of a metal plate.

What is claimed is:

1. A radio-frequency heating apparatus comprising:

a heating chamber for housing a cooking object;

a door that is attached to an opening portion of the heating chamber so as to be able to be opened and closed to thereby allow input and output of the cooking object;

an illumination device for illuminating the cooking object in the heating chamber;

a radio-frequency wave generating device for generating radio-frequency waves;

a waveguide for guiding the generated radio-frequency waves to the heating chamber; and a fan for cooling electric parts including a magnetron that is part of the radio-frequency wave generating device, and an air guide for guiding a wind generated by the fan from the magnetron to the heating chamber, the air guide being made of a metal plate material and having a top plate that is provided with at least one inverted-L-shaped nail to hold the illumination device.

2. A radio-frequency heating apparatus comprising:

a heating chamber for housing a cooking object:

a door that is attached to an opening portion of the heating chamber so as to be able to be opened and closed to thereby allow input and output of the cooking object;

an illumination device for illuminating the cooking object in the heating chamber;

a radio-frequency wave generating device for generating radio-frequency waves;

a waveguide for guiding the generated radio-frequency waves to the heating chamber: and a fan for cooling electric parts including a magnetron that is cart of the radio-frequency wave generating device, and an air guide for guiding a wind generated by the fan from the magnetron to the heating chamber, the air guide being made of a metal plate material and having a top plate that is provided with at least one inverted-L-shaped nail;

wherein the air guide has at least two inverted-L-shaped nails at the top plate, and one nail is inserted in a hole of the illumination device and another nail holds a peripheral portion of the illumination device.

3. The radio-frequency heating apparatus according to claim 1 or 2, wherein the illumination device is attached at such a position that one peripheral portion thereof comes close to an end of the air guide, and when the air guide is attached to the radio-frequency wave generating device the peripheral portion of the illumination device contacts the waveguide.

4. The radio-frequency heating apparatus according to claim 1 or 2, wherein the air guide has a central plate that is provided with a projected surface that is inclined so as to decrease in height in a direction from the outside to the heating chamber.

5. The radio-frequency heating apparatus according to claim 1 or 2, wherein the air guide has a bottom plate that is provided with an inclined surface that is inclined so as to decrease in height in a direction from the outside to the heating chamber.

* * * * *

UNITED STATES PATENT AND TRADEMARK OFFICE

CERTIFICATE OF CORRECTION

PATENT NO. : 6,903,321 B2
DATED : June 7, 2005
INVENTOR(S) : Kanzaki et al.

It is certified that error appears in the above-identified patent and that said Letters Patent is hereby corrected as shown below:

Column 6,
Line 29, please delete “cart” and insert therefor -- part --.

Signed and Sealed this

Twenty-third Day of August, 2005

JON W. DUDAS
*Director of the United States Patent and Trademark Office*